US010765190B2

(12) United States Patent
Offord

(10) Patent No.: US 10,765,190 B2
(45) Date of Patent: Sep. 8, 2020

(54) APPARATUS AND METHOD FOR ELONGATING NATURAL HAIR COILS AND DEFINING NATURAL HAIR COIL PATTERNS

(71) Applicant: Talia J. Offord, Phoenix, AZ (US)

(72) Inventor: Talia J. Offord, Phoenix, AZ (US)

( * ) Notice: Subject to any disclaimer, the term of this patent is extended or adjusted under 35 U.S.C. 154(b) by 58 days.

(21) Appl. No.: 15/382,870

(22) Filed: Dec. 19, 2016

(65) Prior Publication Data

US 2018/0168311 A1 Jun. 21, 2018

(51) Int. Cl.
*A45D 2/00* (2006.01)
*A45D 7/02* (2006.01)

(52) U.S. Cl.
CPC ..... *A45D 2/001* (2013.01); *A45D 7/02* (2013.01); *A45D 2002/003* (2013.01)

(58) Field of Classification Search
CPC . A45D 2/001; A45D 2/00; A45D 7/02; A45D 2002/003
See application file for complete search history.

(56) References Cited

U.S. PATENT DOCUMENTS

| | | | | |
|---|---|---|---|---|
| 520,859 | A * | 6/1894 | Nicol, Jr. | A45D 1/04 132/224 |
| 979,058 | A * | 12/1910 | Bove | A45D 2/44 132/118 |
| 4,261,375 | A * | 4/1981 | Anderson | A45D 2/12 132/224 |
| 4,753,251 | A * | 6/1988 | Guerard | A45D 2/38 132/223 |
| 4,867,185 | A * | 9/1989 | Clingen | A45D 2/22 132/224 |
| 5,025,850 | A * | 6/1991 | Simpson | A45D 2/38 132/223 |
| 2009/0223533 | A1* | 9/2009 | Daley | A45D 2/42 132/211 |
| 2010/0132732 | A1* | 6/2010 | Park | A45D 1/04 132/224 |
| 2015/0027486 | A1* | 1/2015 | Lund | A45D 2/40 132/225 |

FOREIGN PATENT DOCUMENTS

| | | | | |
|---|---|---|---|---|
| WO | WO-2008054090 A1 * | 5/2008 | | A45D 1/04 |

* cited by examiner

*Primary Examiner* — Christopher R Harmon

(57) ABSTRACT

One embodiment of a hair tool 100 to elongate and define natural hair coils 110, where the hair tool 100 comprises top coiling members 120 and bottom coiling members 121, a connector 140, and a securing member 150, 151, wherein a coil of hair 110 placed and secured between the top coiling members 120 and the bottom coiling members 121 can be elongated and/or defined 600. Other embodiments are described and shown 710, 720, 730, 740, and 800.

2 Claims, 7 Drawing Sheets

Figure 1:
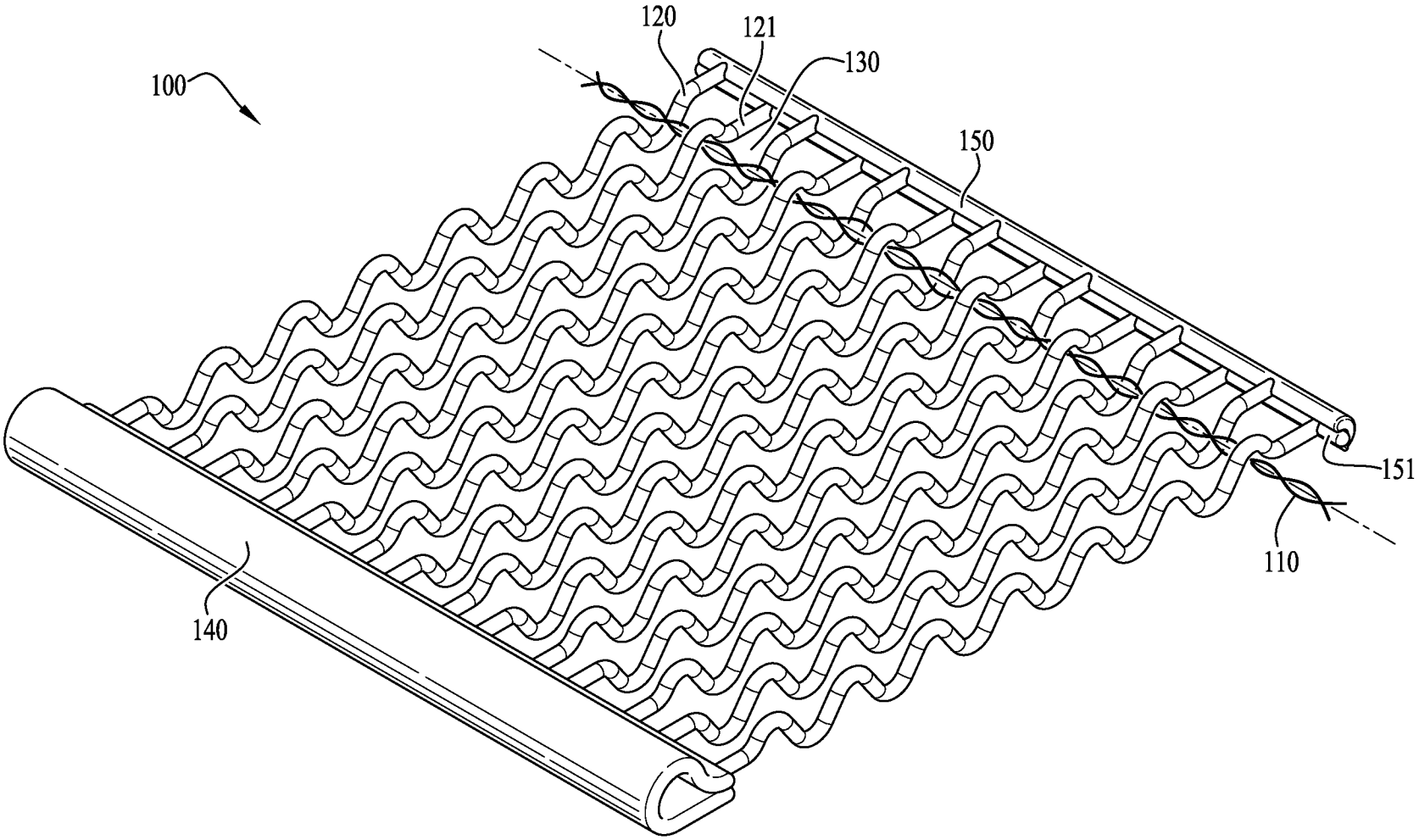

APPARATUS AND METHOD FOR ELONGATING NATURAL HAIR COILS AND DEFINING NATURAL HAIR COIL PATTERNS

CROSS-REFERENCE TO RELATED APPLICATIONS

This application claims the benefit of U.S. Provisional Application No. 6,269,260, filed Dec. 18, 2015.

BACKGROUND

People with some degree of curly, coiled, or kinky hair follicles have found hair-straightening methods exert stress on the hair follicle, causing hair loss and breakage. As a result, it has become increasingly common to wear the hair in its naturally coiled state to avoid such damage. This is also the reason "protective styles"—styles that allow the hair to remain in its natural, resilient, healthful state while placing minimal stress on the hair—such as braiding, twisting, and weaving, have also achieved notoriety among people with naturally coiled hair follicles.

Although preferred for healthful hair, there is a significant disadvantage to wearing the hair in its naturally coiled state, called "shrinkage." "Shrinkage" is the loss or decrease of coil length due to the force of the coil's own stiffness, rigidity, and elasticity working in opposition to the gravitational force. Under the weight of a wetting agent (typically water or hair product), the hair coil can stretch to a maximum coil length. Meaning, the hair follicle maintains its general coil shape or pattern without completely straightening out. However, as the coil dries, it shrinks. It is not atypical to see shrinkage amounts averaging 3 to 9 inches throughout the hair coils on one person's head.

The prior art does not address these issues but instead suffers from a number of disadvantages for people with coiled, kinky, curly hair. The prior art does not provide an efficient, healthful, uniform, non-chemical solution to shrinkage. Overall, the prior art focuses on manipulation of straight hair into a wavy or curly form, or, completely straightening curly, kinky, or wavy hair altogether such as by heat or chemical substance, thereby disrupting the natural coil pattern. By way of summary and example, the devices and methods in present use:

a. do not elongate the coil's natural shape;

b. do not provide a healthful means of creating an elongated, defined coil;

c. do not provide a chemical-free means of creating an elongated, defined coil;

d. do not provide a heat-free or minimal heat means of creating an elongated, defined coil;

e. do not provide an efficient, quick, and simple means of creating an elongated, defined coil; and, f. do not provide a means for achieving versatility of coil pattern throughout the same head.

DRAWINGS

Figures

In the drawings, closely related figures have the same number but different alphabetic suffixes

Figure 2:
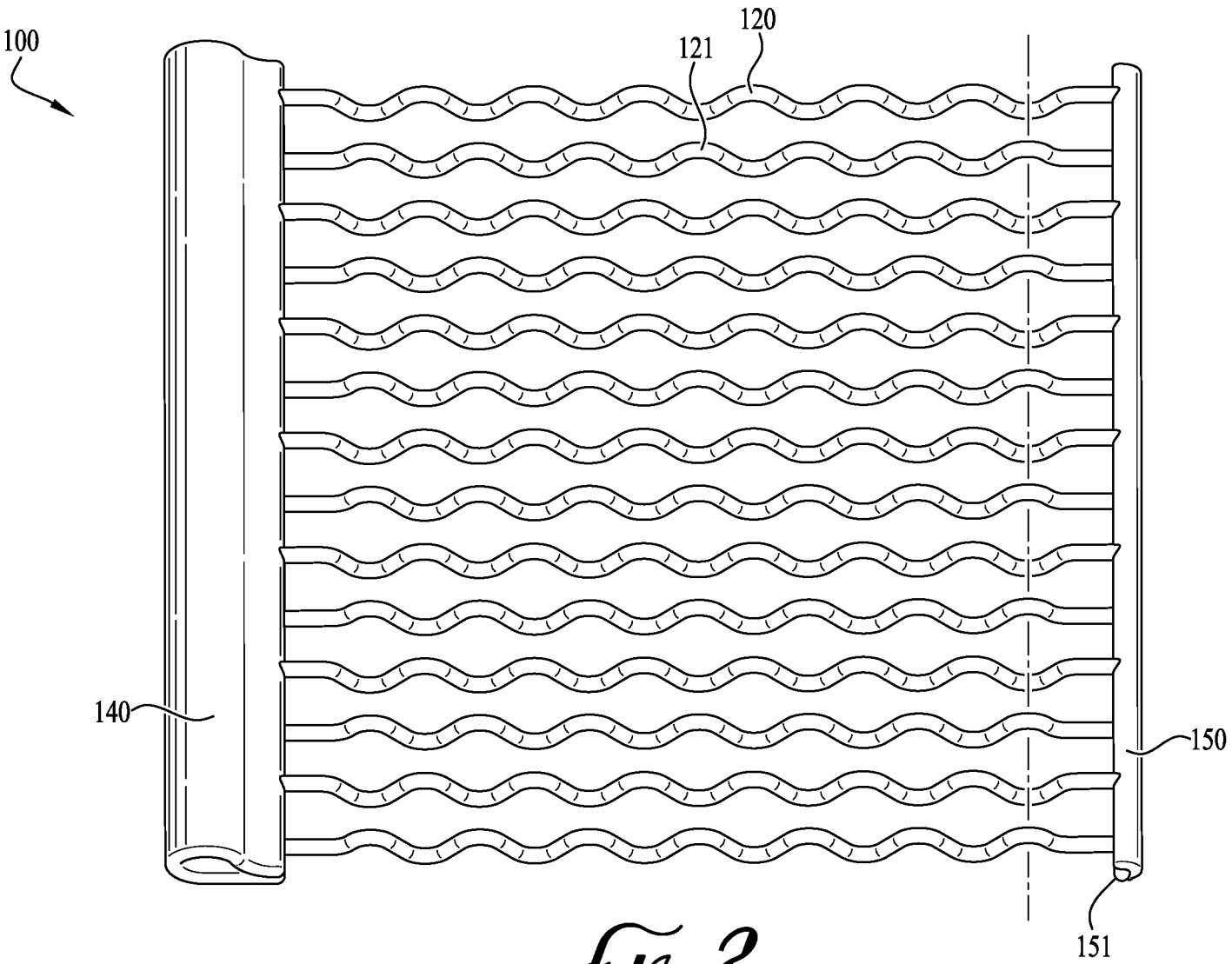
Figure 3:
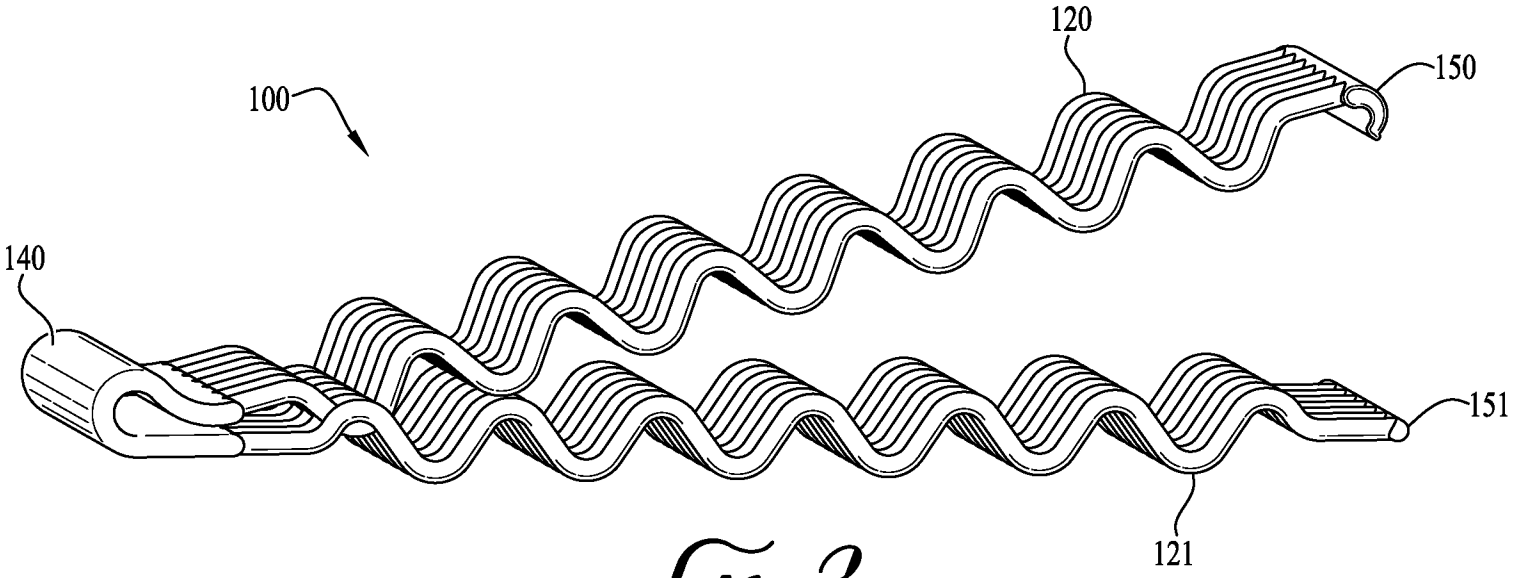
Figure 4:
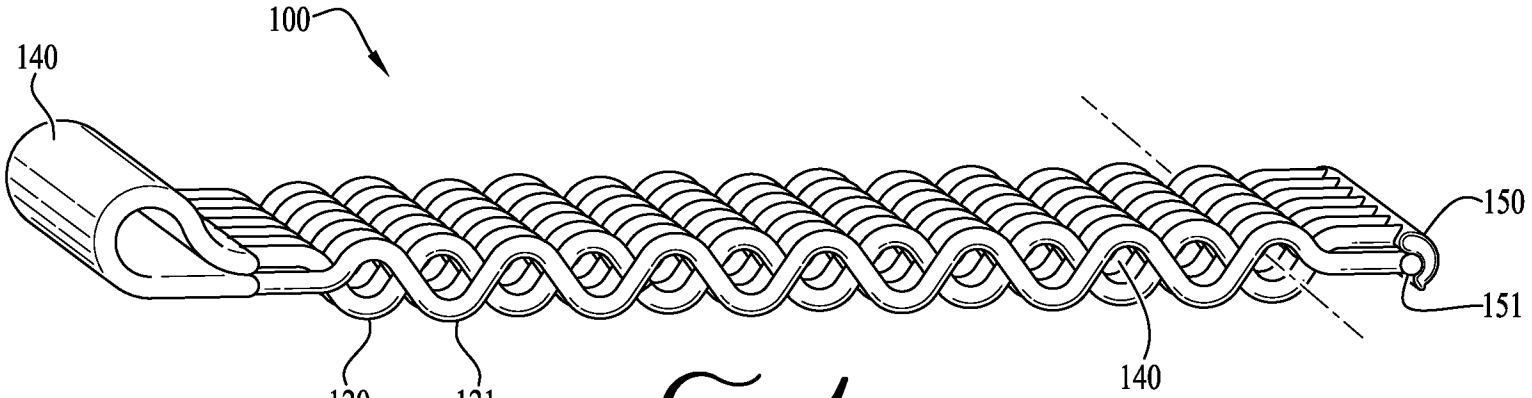
Figure 5:
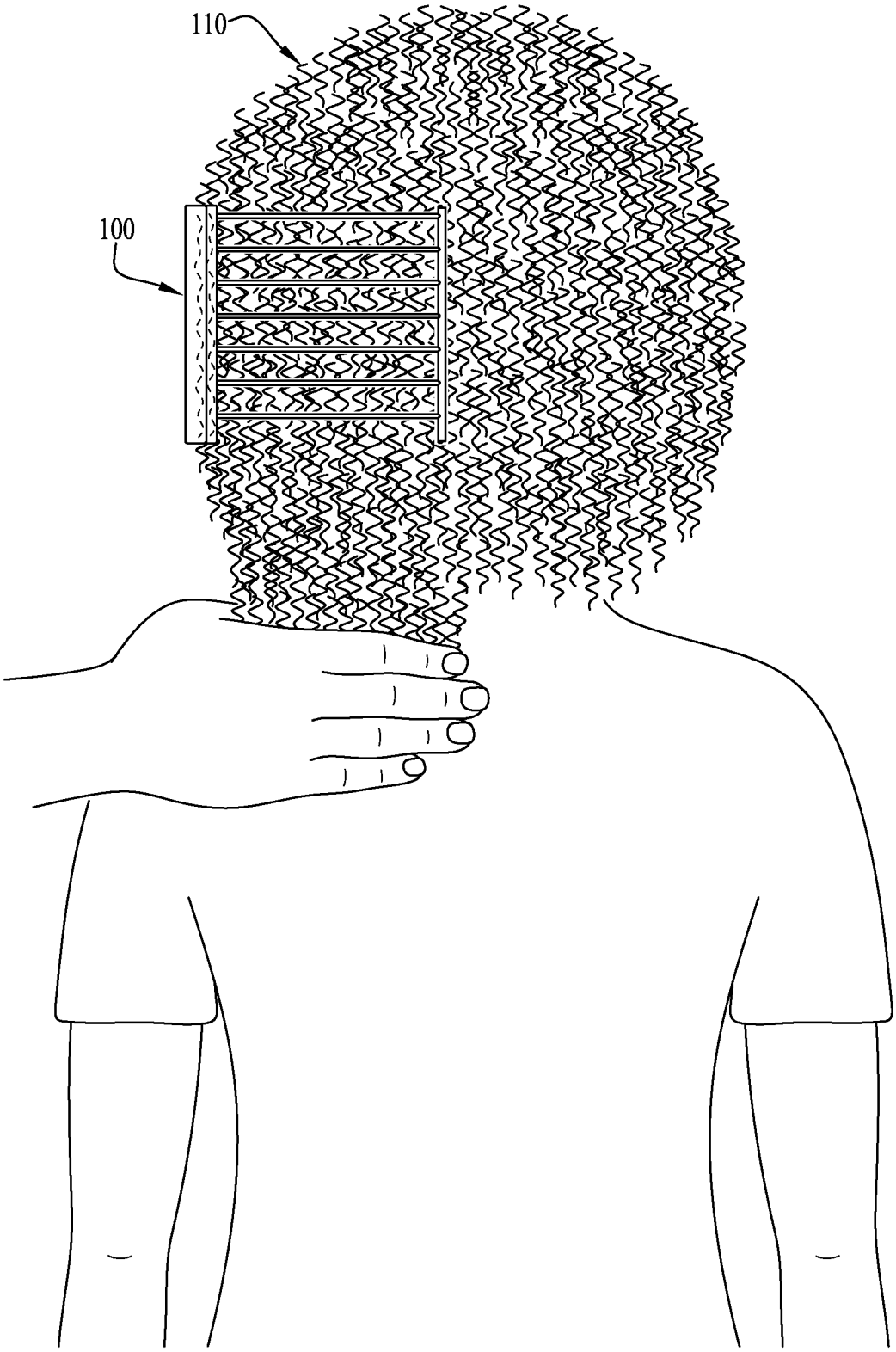
Figure 6:
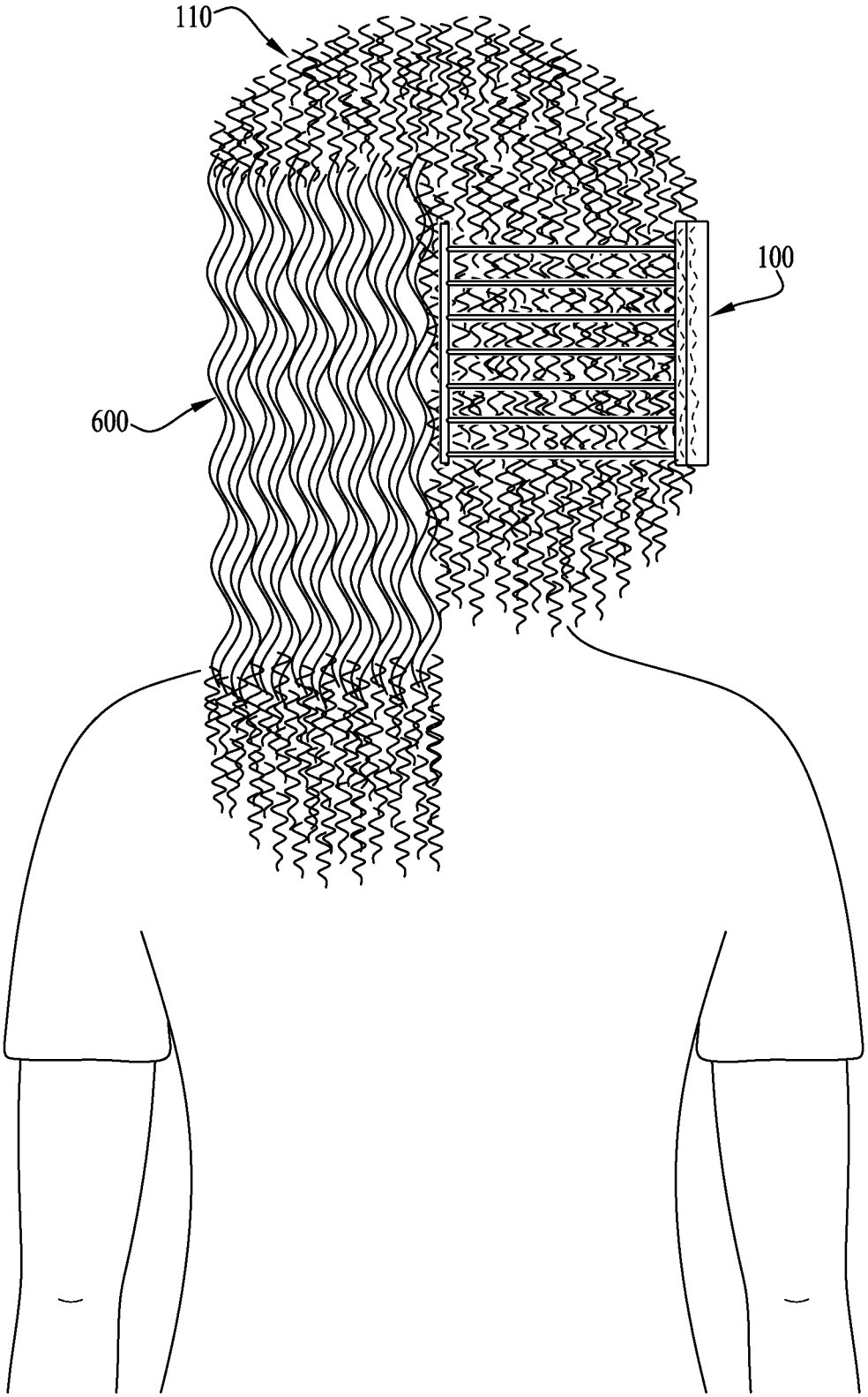
Figure 7A:
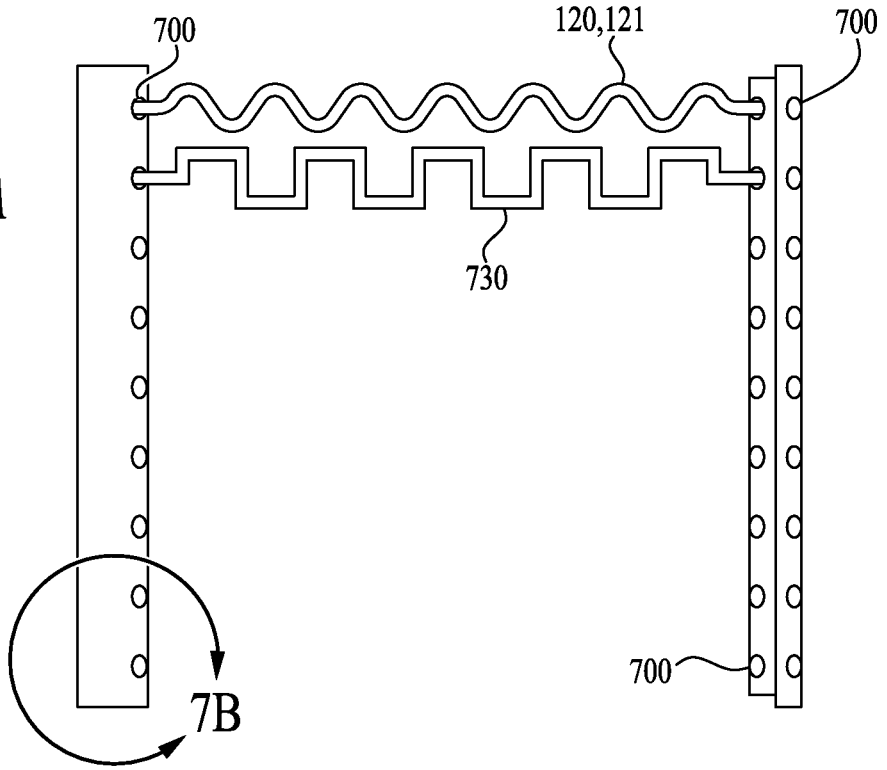
Figure 7B:
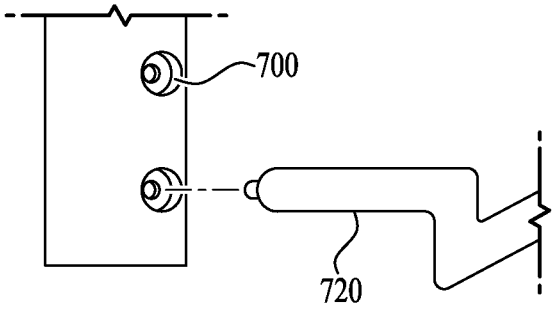
Figure 7C:
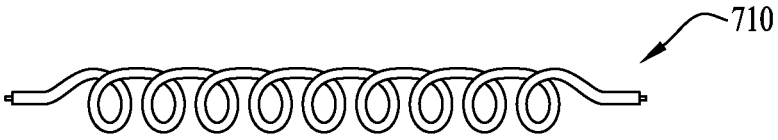
Figure 7D:
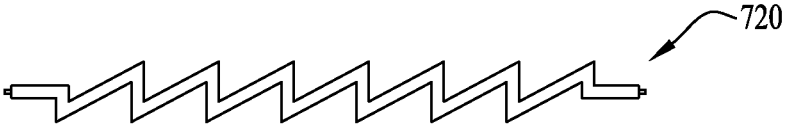
Figure 7E:
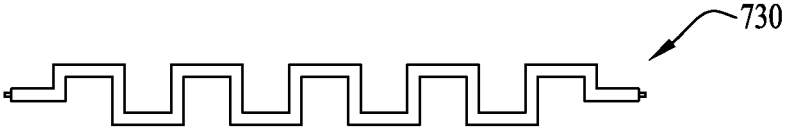
Figure 7F:
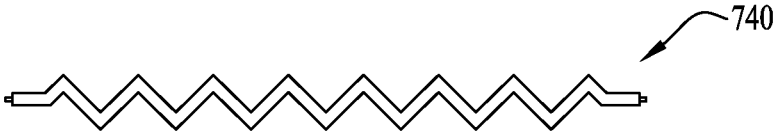
Figure 8A:
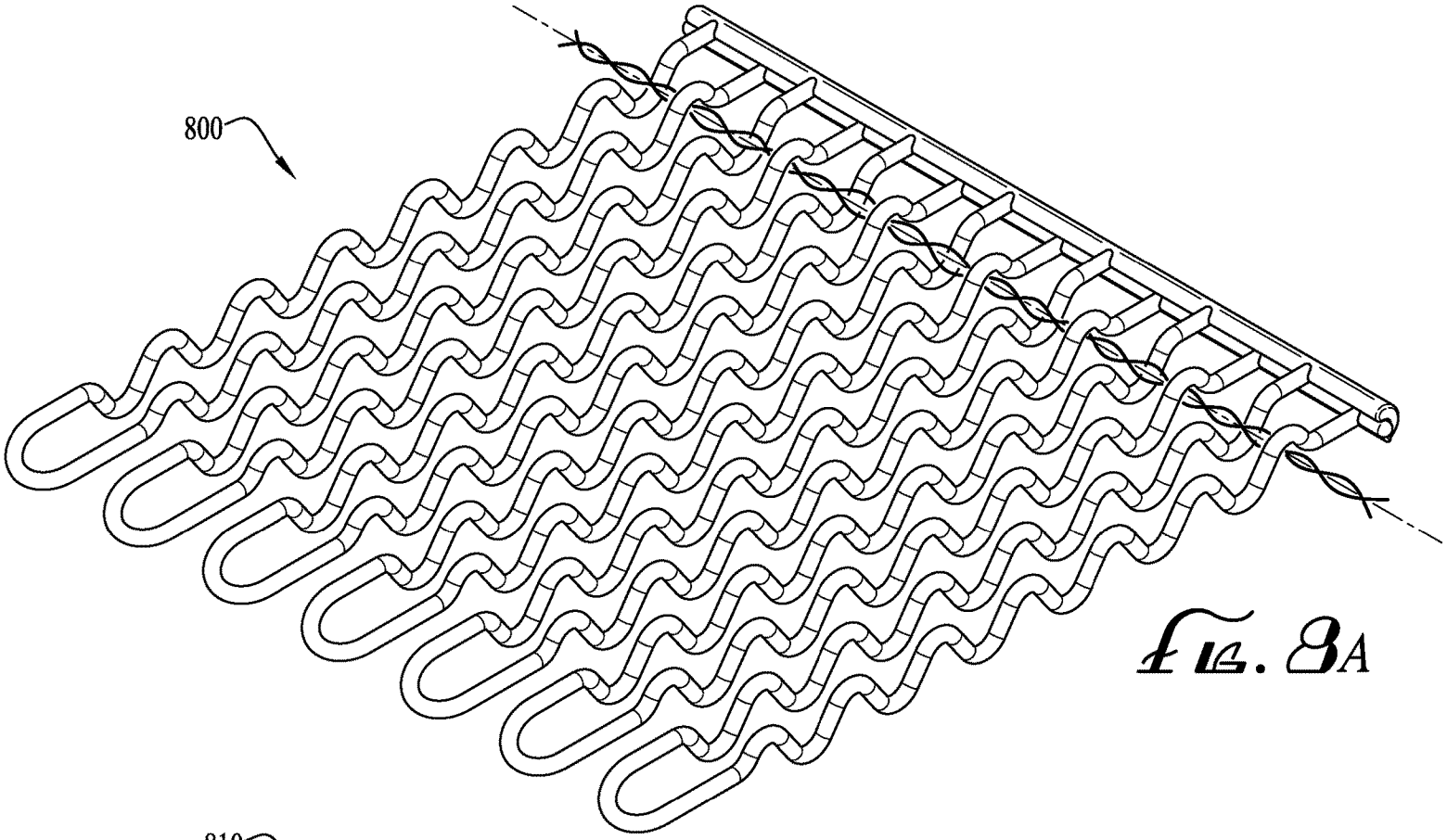
Figure 8B:
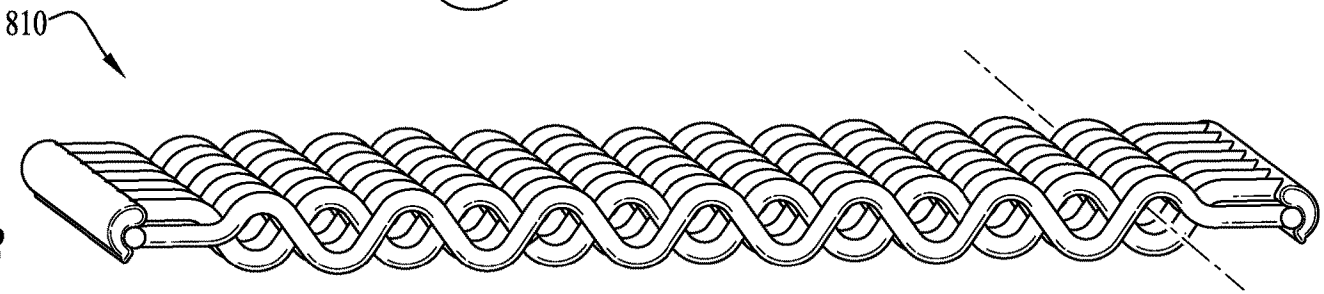

| FIG. # | Description |
|---|---|
| FIG. 1 | Exploded angled top view of a first embodiment |
| FIG. 2 | Top view of a first embodiment |
| FIG. 3 | Side open view of a first embodiment |
| FIG. 4 | Side closed view of a first embodiment |
| FIG. 5 | A view illustrating the manner of use of the first embodiment |
| FIG. 6 | A view illustrating the manner of use as well as the result of the manner of use of the first embodiment |
| FIG. 7A-7F | Additional embodiments of the coiling members |
| FIG. 8A-8B | Additional embodiments of the connector and securing member |

REFERENCE NUMERALS

| Part # | Description |
|---|---|
| 100 | Hair Tool |
| 110 | Pretreated hair coils |
| 120 | top coiling members |
| 121 | bottom coiling members |
| 130 | Spaces between top coiling members and bottom coiling members |
| 140 | Connector |
| 150 | Securing member part one |
| 151 | Securing member part two |
| 400 | Spaces between crests and troughs |
| 600 | Treated hair coils |
| 700 | Grooves |
| 710 | Helical shaped coiling members |
| 720 | Triangle shaped coiling members |
| 730 | Square shaped coiling members |
| 740 | Saw tooth shaped coiling members |
| 800 | Connector |
| 810 | Connector-additional embodiment |

DETAILED DESCRIPTION

In view of the foregoing disadvantages inherent in the prior art, the present apparatus presents at least one of several advantages of one or more aspects, as follows: to provide an apparatus that elongates naturally coiled hair, that elongates naturally coiled hair without heat from devices such as curling or crimping irons and without chemicals, that is quick and easy to apply and use, that is heat-resistant, that can be manufactured in one continuous piece to avoid hair snagging, and that has an open design that allows for quick drying.

In addition to overcoming disadvantages in the prior art, the present apparatus further presents at least one of several other advantages of one or more aspects, as follows: to provide an apparatus that elongates naturally coiled hair, that provides a defined coil pattern of various options, that provides a uniform coil pattern, that provides a coil similar to the hair's own natural coil or a pattern of the user's liking, that maintains the coil's natural pattern, that can be used in solo as one apparatus or as a set of apparatuses throughout the head, that can be manufactured in multiple sizes to treat a variety of hair lengths, that can be manufactured in materials comfortable for extended and overnight wear thereby avoiding an opportunity for breakage, that is versatile to achieve a desired effect, that is customizable to provide different treatment effects, and that may be used in conjunction with and in improvement of other protecting styling methods, such as hair extensions. Other advantages of one or more aspects will be apparent from a consideration of the drawings and related descriptions.

In accordance with the following illustrations, one representative embodiment of the present apparatus comprises top and bottom horizontal interengaging and opposing coiling members of predetermined material, size, shape, and spacing, connected perpendicularly on one end to a connector of predetermined material, structure, size, and shape, and on the other end, a member or structure for fastening and releasing the top coiling members and bottom coiling members with the function of proving a firm, secure, and consistent hold on a section of hair when held between the top coiling members and bottom coiling members, wherein a hair coil can be elongated and/or defined. In another embodiment, the coiling members are detachable and interchangeable and another securing member replaces the connector.

First Embodiment—FIGS. 1-6

With reference to the drawings, one embodiment of the hair tool for elongating and defining a natural hair coil, generally designated as 100, is illustrated in FIGS. 1 through 6. By elongating a natural hair coil, the hair tool 100 solves the shrinkage problem left unsolved by the prior art. The prior art manipulated relatively straight hair by use of hair rollers or wave plates, as opposed to defining or distinguishing hair that is already wavy, curly, coiled, or kinky. The hair tool 100 defines and distinguishes hair that is naturally coiled 110.

FIG. 1 shows an angled top view of the hair tool 100. FIGS. 1-4 show the hair tool 100 has interengaging and opposing horizontal teeth or coiling members divided between a top portion or top coiling members 120, and a bottom portion or bottom coiling members 121, a spine or connector 140 to connect the top coiling members 120 and bottom coiling members 121, and a securing member divided between a part one 150 and part two 151 which collectively prove a firm, secure, and consistent hold on a section of hair so as to allow a hair coil in its natural state 110 to form in its natural coil pattern, but in an elongated, uniform, and/or defined state 600 when secured between the top coiling members 150 and bottom coiling members 151 (FIG. 6).

Although it is optimal to retain the maximum coil length after styling, the hair tool 100 provides the user with the option to form coils at any length: an elongated length, the same length, or even a shorter length than where the coils rest naturally. This is accomplished by placing the pretreated hair coils 110 at the desired final resting place within the hair tool 100, thereby causing the hair coil 110 to be treated and therefore formed and solidified at that length.

There are various possibilities with regard to the shape of the coiling members 120 and 121, as illustrated in FIG. 7 and further discussed in the additional embodiments section. In one embodiment, the top coiling members 120 and bottom coiling members 121 are a transverse sine shape that can impose a sine wave pattern or effect on the hair (FIG. 1). The coiling members 102, 121 are an overall cylindrical form (FIGS. 1, 4). The thickness or diameter of the body of each coiling member 120, 121 is substantial enough to provide the surface area necessary to secure a portion of hair between the top coiling members 120 and bottom coiling members 121. In one embodiment, the diameter of the coiling members 120, 121 is approximately 1 to 2 cm. However, the diameter in other embodiments can range from approximately 3 to 5 cm to achieve varying effects on the hair and for treatment of varying lengths of hair.

FIGS. 1-2 and 5-6 show the coiling members 120, 121 have predetermined opposing spaces 130 between the individual coiling members to provide air flow for quick drying when applying the hair tool 100 to damp or wet hair. In one embodiment, the spaces 130 are equidistant throughout the hair tool 100 (FIGS. 1 and 2). However, other embodiments may consist of unequal spaces 130 which can achieve different effects for the user.

FIG. 4 shows the top coiling members 120 and bottom coiling members 121 have predetermined spaces 400 between the corresponding crests and troughs of the top coiling members 120 and bottom coiling members 121. In other words, the crest of one portion 120 or 121 and the adjacent trough of the other portion 120 or 121 form the space between the crests and troughs 400. In one embodiment, the space 400 has a diameter of approximately 0.5 cm. However, other embodiments may consist of other diameters to achieve different treatment effects for the user, including but not limited to 1 cm, 1.5 cm, or 2 cm.

The spaces 130, 400 in concert with the securing member 150, 151 and connector 140 allow the pretreated hair coils 110 to form in their own unique pattern by capturing and holding the pretreated hair coils 110 in their natural form. This reduces opportunities for pattern disruption, which causes the pretreated hair coil 110 to appear fuzzy and devoid of pattern. The hair tool 100 supports the pretreated hair coils 110 while they solidify into a defined pattern 600.

The wavelength and amplitude of the coiling members 120, 121 are substantial enough to receive a portion of hair for treatment (FIGS. 1, 3-7). In one embodiment, the wavelength and amplitude of the coiling members 120, 121 are both approximately 0.5 cm. However, other embodiments may have different wavelengths and amplitudes of equal or differing measurements so long as the measurements are substantial enough to receive a portion of hair for treatment. For example, other embodiments could have wavelengths and amplitudes ranging from approximately 3 to 5 cm.

The connector 140 provides the function of securing and stabilizing the pretreated hair 110 between the top coiling members 120 and bottom coiling members 121. In one embodiment, at one end of the hair tool 100, the coiling members 120, 121 are connected perpendicularly to the connector 140 (FIG. 1). In other embodiments, the connector 140 may be connected to the coiling members 120, 121 at different angles. In one embodiment, the connector 140 extends the complete length of the hair tool 100 (FIG. 1). In other embodiments, the connector 140 may be shorter or longer than the entire length of the coiling members 120, 121. The connection between the connector 140 and the coiling members 120, 121 is seamless to prevent catching and snagging the hair. In one embodiment, the connector 140 forms a rectangular, concave area (FIGS. 1-4).

At the opposite end of the hair tool 100, the top coiling members 120 are seamlessly connected to the securing member part one 150 (FIGS. 1, 2). The bottom coiling members 121 are seamlessly connected to securing member part two 151 (FIGS. 1, 2). The connections are seamless to prevent catching and snagging the hair. The securing member 150, 151 extends the complete length of the hair tool 100 in order to provide a firm hold for the hair tool 100 in the fastened state (FIGS. 1-4). Other embodiments may comprise shorter lengths of the securing member 150 or 151 so long as a firm hold is accomplished.

In one embodiment, the securing member 151, 151 is a bar and corresponding rim 114 (FIGS. 1, 3). Thus, a bar and corresponding rim can be used to fasten and release the top coiling members 120 and bottom coiling members 121 for the purpose of providing a secure, firm, and consistent hold. The fastening of the hair tool 100 onto the hair by engaging the securing member 150, 151 causes the coiling members 120, 121 to produce its pattern transversely onto the pretreated hair coils 110. The securing member 150, 151 reduces the need for any special skill by holding the hair tool 100 in place (FIGS. 5-6).

In one embodiment, the resting position of the hair tool 100 is the substantially closed position (FIGS. 1, 2, 4). The closed position is the position in which the top coiling members 120 and bottom coiling members 121 are adjacent (FIG. 1, 2, 4). The open position is the opposite, as illustrated in FIG. 3. In other embodiments, the resting position can range in degrees from the closed position.

In one embodiment, the coiling members 120, 121, connector 140, and securing member 150, 151 are a firm, flexible, lightweight, heat-resistant plastic created through plastic injection molding. However, these parts can be comprised of any other material that can be repeatedly bent without fracturing or losing strength and rigidity, such as a metal coated or not coated by a plastic. In embodiments comprising metal, heat can be applied directly to the metal. Heat can come in any form acceptable by the user, such as a hand-held blow dryer or a hooded blow dryer.

The hair tool 100 can comprise many sizes to fit any hair length. The length and width of the hair tool 100 can be any length and width substantial enough to accomplish treatment of a portion of hair. For example, in one embodiment, the width of the hair tool 100 is at least 4 inches and the length of the hair tool 100 is at least 2 inches. However, in another embodiment, the width of the hair tool 100 could be approximately 2 inches while the length of the hair tool 100 could be approximately 20 inches. This variation can allow for customization to accommodate various lengths of hair.

The user may treat as much of the hair as desired and may use one or more hair tool 100 apparatuses concurrently throughout the head as desired. For example, some users may desire treatment with the hair tool 100 to elongate pretreated hair coils 110 in the top or crown section of the head to match the length of hair coils in the back section of the head. Other users may desire treatment with the hair tool 100 to impose a pattern on one section of hair to match other sections of hair or create a different pattern altogether. These users may apply the hair tool 100 only in those areas where treatment is desired and may use one or more hair tools 100 concurrently to accomplish treatment. More than one hair tool 100 may be used, including hair tools 100 of different sizes or dimensions.

Another disadvantage of wearing the hair in the naturally coiled or pretreated state is coil patterns may not be uniform throughout a person's head, varying in stiffness or tightness throughout the head. Further, some hair coils may possess no pattern at all, but instead may have a flattened, fuzzy, or z-pattern appearance or shape.

The hair tool 101 may also be used in connection with some hair extensions techniques such as the sew-in technique, as an improvement thereof. One way to achieve the appearance that the hair extensions are real or authentic—i.e. growing out of the head person's head—is to leave out some of the person's actual or real hair ("leave out") to blend or cover up the place where the extensions wefts are sewn, glued, or otherwise connected. However, when the pattern of the leave out does not match or blend with the pattern of the hair extensions, the extensions do not look real or authentic. The hair tool 101 may be used to treat the leave out to match or blend to the pattern of the hair extensions.

Operation of First Embodiment—FIGS. 1-6

For this embodiment, the manner of using the hair tool 100 to elongate and/or define a pattern of pretreated hair coils 110 is illustrated in FIGS. 3 through 6.

Prior to treatment with the hair tool 100, a user may desire to apply a substance to wet, dampen, moisturize, or otherwise manipulate the pretreated hair coils 110. The user should select whatever substance they desire and apply it wherever they desire. For example, the user may apply a leave-in conditioner, moisturizer, hair spray, water, oil, or any other desired substance.

Choose pretreated hair coils 110 for treatment in one hair tool 100. The amount of pretreated hair coils 110 selected should correspond to the size of the hair tool 100 (FIGS. 5 and 6). The minimum amount of hair may be chosen at the user's discretion, however, the maximum amount should not exceed an amount that would prevent fastening of the securing member 150, 151.

Open the hair tool 100 by releasing or disengaging securing member part one 150 from securing member part two 151 (FIGS. 3, 4). The securing member 150, 151 may already be disengaged, depending on prior use, so this step can be skipped if the securing member 150, 151 is already disengaged.

Insert the selected pretreated hair coils 110 between the top coiling members 120 and bottom coiling members 121 (FIG. 5). The pretreated hair coils 110 can be spread evenly between the top coiling members 120 and bottom coiling members 121. Position the pretreated hair coils 110 at the user's desired final length (FIG. 5) by stretching or compressing the hair coils to where the user desires the pretreated hair coils 110 to rest after treatment (FIGS. 5, 6).

Fasten or engage the securing member part one 150 with securing member part two 151, thereby bringing the top coiling members 120 and bottom coiling members 121 firmly and securely adjacent to each other.

Stretching the hair coil 110 in conjunction with securing the hair in the hair tool 100 for the duration of the treatment period causes the elongation. In concert with the connector 140 and spaces 130, 400, the coiling members 120, 121 will produce their pattern transversely onto the pretreated hair coils 110. These phenomenon are collectively referred to as treatment.

Allow the securing member 150, 151 to remain engaged for a predetermined amount of time. This predetermined amount of time is called the treatment period. The treatment period can be determined by the user and can depend on a number of variables, including the amount of moisture in the hair, the desired effect, and whether heat is used. For example, more moisture may extend the treatment time. The use of heat may shorten the treatment time. While heat is not required, heat may be applied by any method desired by the user, such as a hand-held blow dryer or a hooded dryer. Allowing the hair to dry or treat in the ambient air, i.e. air drying, is also a viable option. The user can adjust the degree or amount of definition of a pattern by extending the treatment time (more defined) or decreasing the treatment time (less defined). The treatment period may last anywhere from minutes up to overnight.

Unfasten or disengage the securing member part one 150 from securing member part two 151, thereby separating the top coiling members 120 and bottom coiling members 121. Remove the hair tool 100 from the hair coils, which are now treated hair coils 600. Thus, a natural coil of hair 110 can be elongated and/or defined into a pattern 600, as the prior art has failed to do (FIGS. 5-6).

This process should be repeated for each hair tool 100 in use.

Additional Embodiments—FIG. 7

In FIGS. 1-6, the coiling members 120, 121 are of the sine wave coiling pattern or shape. However, there are various possibilities with regard to the shape of the coiling members 120 and 121 (FIG. 7). By way of example, FIG. 7 shows the coiling members 120 and 121 may consist of different shapes such as helical 710 (FIG. 7C), triangle 720 (FIG. 7D), square 730 (FIG. 7E), or saw tooth 740 (FIG. 7F), each of which can provide a pattern, definition, or effect to the hair coil that is imposed by that shape and corresponding spaces 130, 400. These additional shapes are desirable for both similar hair patterns and dissimilar hair patterns alike depending on the user's preference. In another embodiment, the coiling members may also be curved concavely to follow the natural curve of a head. The wavelength and amplitude of the additional embodiments of the coiling members 710, 720, 730, 740 is substantially the same as the wavelength and amplitude of the coiling members in the first embodiment 120, 121.

There are various possibilities with regard to the securing member 150, 151. For example, other embodiments may comprise hooks, snap fasteners, or any other type of fastener that can provide a consistent, firm, and secure hold. Thus, these embodiments comprise other options for fastening and releasing the top coiling members 120 and lower 121 coiling members for the purpose of providing a secure, firm hold.

There are various possibilities for the connector 140. For example, in another embodiment, the connector 140 is a seamless continuation of the coiling members 120, 121 (FIG. 8A). In this embodiment, the continuation is represented as the coiling members 120 and 121 in a bent form to create a collective concave corner or joint (FIG. 8A). Therefore, instead of a rectangular concave shape as provided in the first embodiment (FIGS. 1 and 2), the collective bend of the coiling members 120, 121 serve the function of securing and stabilizing the hair tool 100 (FIG. 8A). In another embodiment, the hair tool 100 can have one or more connectors 140.

In another embodiment, the hair tool 100 can comprise one or more securing members 150, 151 (FIG. 8B). For example, instead of a connector 140 (FIG. 4), the hair tool 100 can comprise another securing member 150, 151 (FIG. 8B). In this embodiment, the coiling members 120, 121, 710, 720, 730, 740 are secured on both sides by securing members 150, 151 (FIG. 8B).

Further Embodiments—FIG. 7

In another embodiment shown in FIG. 7A, the coiling members 120, 121, 710, 720, 730, 740 are detachable from the connector 140 and securing member 150, 151 and exchangeable within the hair tool 100. In this embodiment, the connector 140 and securing member 150, 151 contain holes, recesses, or grooves 700 that correspond to the ends of the coiling members 120, 121, 710, 720, 730, 740. The coiling members 120, 121, 710, 720, 730, 740 may be detached and reattached to the connector 140 and securing member 150, 151 by way of the grooves 700 (FIG. 7A, 7B). The size or diameter of the grooves 700 corresponds to the diameter of the ends of the coiling members 120, 121, 710, 720, 730, and 740.

The exchangeability feature of the coiling members 120, 121, 710, 720, 730, 740 provides the user with the flexibility of achieving different spaces 130 between the coiling members within the top 120 and bottom 121 parts by leaving some grooves 700 vacant, thereby allowing for different treatment effects as the user may desire (FIG. 7A). The exchangeability feature also provides the user with the option of simultaneously using coiling members of different shapes 120, 121, 710, and 720, thereby allowing additional flexibility to apply different patterns to various sections of hair, which is particularly desirable for people who possess or desire more than one coil pattern throughout the head (FIG. 7A). The exchangeability feature also provides the flexibility of using the hair tool 100 in concert with other protective styling methods, such as hair extensions of the braiding application technique because the user can select coiling members that match or complement the hair extensions 120, 121, 710, 720, 730, 740, thereby enhancing and improving upon those other styling methods.

Operation of Further Embodiments—FIG. 7

The operation for this embodiment is the same as the operation of the first embodiment but starting with these additional steps for the selection of detachable coiling members 120, 121, 710, 720, 730, 740. Remove the coiling members 120, 121, 710, 720, 730, 740, if any, which are not desired for current treatment in the hair tool 100.

Choose the desired coiling members for treatment 120, 121, 710, 720, 730, 740. The user may select any combination of shapes of coiling members 120, 121, 710, 720, 730, 740. While the user may chose to leave some grooves 700 vacant for a different effect, the total amount of coiling members chosen 120, 121, 710, 720, 730, 740 cannot exceed the amount of available grooves 700.

Insert the selected coiling members 120, 121, 710, 720, 730, 740 into the corresponding grooves 700 on the connector 140 and securing member 150, 151.

Proceed with the operation as provided under the first embodiment.

CONCLUSION, RAMIFICATIONS, AND SCOPE

Accordingly, the reader will see that the hair tool of the various embodiments provides a quick, healthy, non-chemical solution to shrinkage by providing coil elongation and hair coil pattern definition, which may be used alone or in conjunction with other protective styling methods. The hair tool may be comprised of various different coiling member shapes and combinations of the shapes, thereby providing a great range of flexibility for coil pattern definition. The hair tool width and length range allows for adaptability for use with all lengths of hair.

Although the description contains many specificities, they should not be construed as limiting the scope of the embodiments but as merely providing illustrations of some of several embodiments. For example, the coiling members can have other patterns or shapes, such as helical, square, saw tooth, or triangle. The coiling members can be bowed to conform to a head shape. Thus, the scope of the embodiments should be determined by the appended claims and their legal equivalents, rather than by examples given.

I claim:

1. A hair tool for elongating and defining hair coils comprising top and bottom opposing half portions each having a plurality of spaced apart cylindrical coiling members; said coiling members of each half portion are connected at opposing ends by at least one connector and at least one securing member to secure top and bottom half portions together; each coiling member is non-linear extending in a longitudinal direction providing ridges and troughs in a transverse direction; said opposing half portions are configured to be separated in an open position to accept hair coils therebetween and a closed secured position wherein hair coils are captured and held between opposing portions in a hair treatment position.

2. The hair tool of claim 1, wherein coiling members provide non-linear profiles comprising sine wave, helical, square, saw tooth or triangle shapes.

* * * * *